US009790742B2

(12) United States Patent
Spreitzer

(10) Patent No.: US 9,790,742 B2
(45) Date of Patent: Oct. 17, 2017

(54) DRILLING APPARATUS AND METHOD FOR DRILLING

(71) Applicant: BAUER Spezialtiefbau GmbH, Schrobenhausen (DE)

(72) Inventor: Stefan Spreitzer, Aresing (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 14/914,469

(22) PCT Filed: Aug. 27, 2013

(86) PCT No.: PCT/EP2013/067731

§ 371 (c)(1),
(2) Date: Feb. 25, 2016

(87) PCT Pub. No.: WO2014/117874

PCT Pub. Date: Aug. 7, 2014

(65) Prior Publication Data

US 2016/0201394 A1 Jul. 14, 2016

(51) Int. Cl.
*E21B 7/02* (2006.01)
*E21B 43/10* (2006.01)
(Continued)

(52) U.S. Cl.
CPC ..... *E21B 7/024* (2013.01); *E02D 17/13* (2013.01); *E02F 3/205* (2013.01); *E21B 7/02* (2013.01); *E21B 43/10* (2013.01)

(58) Field of Classification Search
CPC ..... E02D 17/13; E02F 3/205; E21B 43/10; E21B 7/02; E21B 7/024
See application file for complete search history.

(56) References Cited

U.S. PATENT DOCUMENTS 3,225,849 A * 12/1965 La Casse ..... B62D 55/084 180/9.5
3,645,343 A * 2/1972 Mays ..... E21B 7/02 173/147
(Continued)

FOREIGN PATENT DOCUMENTS

DE 197 29 315 A1 1/1990
DE 38 09 626 C2 3/1994
(Continued)

OTHER PUBLICATIONS

International Preliminary Report on Patentability and Translation of Written Opinion of the International Searching Authority; PCT/EP2013/067731 dated Mar. 1, 2016.
(Continued)

*Primary Examiner* — James G Sayre
(74) *Attorney, Agent, or Firm* — Studebaker & Brackett PC

(57) ABSTRACT

The invention relates to an earth working apparatus having an undercarriage which is designed as a running gear, and an upper carriage which is supported in a rotatable manner on the undercarriage and has a driver's cab as well as a drive motor for the undercarriage. According to the invention, between the undercarriage and the upper carriage an extension segment is arranged, through which a vertical distance between the undercarriage and the upper carriage is extended. On the extension segment between the undercarriage and the upper carriage a support means for tilt protection is mounted. The invention furthermore relates to a method for earth working with an earth working apparatus of such type.

12 Claims, 3 Drawing Sheets

Figure 1:
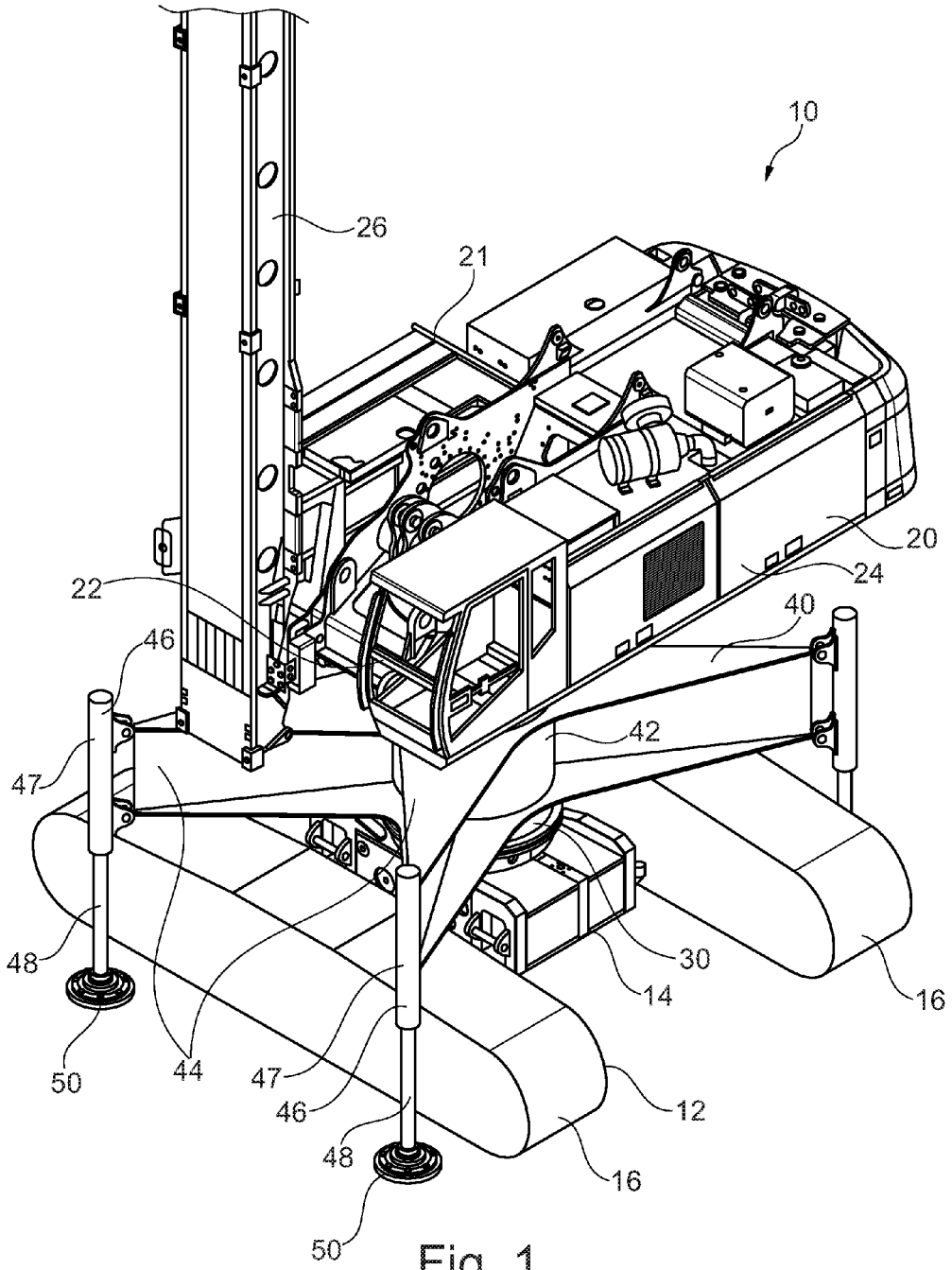

(51) Int. Cl.
*E02D 17/13* (2006.01)
*E02F 3/20* (2006.01)

(56) References Cited

U.S. PATENT DOCUMENTS

| | | | | |
|---|---|---|---|---|
| 5,337,847 | A | 8/1994 | Woods et al. | |
| 6,105,699 | A * | 8/2000 | Hinds | B62D 33/063 180/89.13 |
| 6,241,263 | B1 | 6/2001 | Hicks | |
| 7,178,682 | B2 * | 2/2007 | Willim | B66C 23/84 180/9.46 |
| 2004/0256344 | A1 | 12/2004 | Willim | |
| 2010/0264694 | A1 | 10/2010 | Crawford | |
| 2011/0147090 | A1 | 6/2011 | Ditillo et al. | |

FOREIGN PATENT DOCUMENTS

| | | | |
|---|---|---|---|
| DE | 103 60 912 | B3 | 5/2005 |
| DE | 103 60 918 | A1 | 7/2005 |
| EP | 0745528 | A2 | 12/1996 |
| EP | 1 418 152 | A1 | 5/2004 |
| GB | 1 487 935 | A | 10/1977 |
| JP | 2010-031523 | A | 2/2010 |
| WO | 97/43491 | A1 | 11/1997 |

OTHER PUBLICATIONS

International Search Report—PCT/EP2013/067731 dated Oct. 6, 2014.
Liebherr; Mobile and Crawler Cranes Catalogue.
Liebherr; Crawler Crane LR 1600/2—Technical Data.
Liebherr; Crawler Crane LR1600/2-W—Supplement to technical data data sheet LR 1600/2.
Sennebogen; Technical Specification.

* cited by examiner

DRILLING APPARATUS AND METHOD FOR DRILLING

The invention relates to an earth working apparatus having an undercarriage, which is designed as a running gear, and an upper carriage, which is supported in a rotatable manner on the undercarriage and has a driver's cab as well as a drive motor for the undercarriage, in accordance with the preamble of claim 1.

The invention furthermore relates to a method for earth working, in which on a ground around a working location a supplementary means is arranged, which has a predetermined height with respect to the surface of the ground, in accordance with the preamble of claim 11.

A generic earth working apparatus can be taken from EP 1 418 152 A1 or from DE 103 60 918 B3 for example.

On the rotatable upper carriage the mast with a movable drill drive are arranged on a front side, whereas on the opposite lying rear area of the upper carriage the main drive motor and further drive units are arranged for weight counterbalance. In addition, support feet can be mounted on the upper carriage so that the earth working apparatus is stabilized and supported sufficiently with respect to the ground especially in the case of working operations in which large forces are being applied. The aim is to keep the overall center of gravity of the earth working apparatus as close to the ground as possible to reduce the risk of tilting.

In the case of the earth working apparatus according to DE 103 60 912 B3 a pipe rotation device is arranged at the lower end of the mast in addition to a rotary drive for a drilling tool that is movable along the mast. The said device serves for screwing in a drill pipe that serves to support the borehole wall for example. From DE 38 09 626 C2 or DE 197 29 315 A1 casing machines for introducing a drill pipe are known which can also be employed separately from the earth working apparatus, especially if the casing machine is relatively large. Depending on the drill pipe diameter such a separate casing machine can have a height of a few meters. A drilling apparatus is used for the further drilling and excavation of the ground material from the borehole, in which case a discontinuous drilling method, for instance using a drilling bucket or a short drilling auger, is frequently employed. To empty the drilling tool from drilled-out ground material the upper carriage of the drilling apparatus has to be pivoted repeatedly away from the borehole into an unloading position. During this pivoting movement care must be taken that the rear of the upper carriage does not collide with the upper end of the casing machine. In this process a movement of the undercarriage is undesirable, as this would require a laborious readjustment of the earth working apparatus at the borehole.

To prevent a collision during the pivoting of the upper carriage it is known that the casing machine is either arranged in a recess or that a pedestal is set up at the borehole, on which the earth working apparatus is located in an elevated position with respect to the casing machine. However, these additional measures prove to be time-, work- and cost-intensive. This applies in particular if a plurality of such bores has to be produced.

The invention is based on the object to provide an earth working apparatus and a method for earth working, with which an efficient and at the same time safe operation is achieved even if relatively large supplementary means are employed at a ground working location.

The object is achieved on the one hand by an earth working apparatus having the features of claim 1 and on the other hand by a method for earth working having the features of claim 11. Preferred embodiments of the invention are stated in the respective dependent claims.

The earth working apparatus according to the invention is characterized in that between the undercarriage and the upper carriage an extension segment is arranged, through which a vertical distance between the undercarriage and the upper carriage is extended, and in that on the extension segment between the undercarriage and the upper carriage a support means for tilt protection is mounted.

A first aspect of the invention resides in the fact that the upper carriage is displaced in its entirety with respect to the undercarriage and that a greater operating height above the ground surface is attained by interposing an extension segment. The said extension segment can be of modular design, consisting in itself of several segment pieces. In this way, a desired height can be set. Any larger constructional modifications on the undercarriage or the upper carriage are, in principle, not necessary. Solely the drive and supply lines between upper carriage and undercarriage, which are guided through the extension segment, have to be extended and adapted accordingly.

A further aspect of the invention resides in the fact that on the extension segment a support means for tilt protection is mounted. This ensures adequate safety against tilting despite the raised center of gravity of the entire apparatus.

Moreover, on account of the additional support means between the upper carriage and the undercarriage the wear occurring in the undercarriage during work operations is reduced. Because once the support means is extended the force flow occurs to a substantial degree via the support means, thereby relieving the undercarriage and the numerous wheel bearings on the undercarriage. As a result of the improved rigidity the working precision during earth working is increased too.

According to a preferred embodiment of the invention provision is made for the extension segment to be designed in a sleeve-shaped manner. Hence, the drive and supply lines between the upper carriage and the undercarriage can be guided inside the sleeve-shaped extension segment. At the same time, there is ample free space on the external side of the segment in order to mount the support means.

Basically, it is possible that the extension segment is firmly mounted on the upper carriage so that the rotary movement occurring during the pivoting of the upper carriage takes place between the extension segment and the undercarriage. It is also possible that due to the raising of the entire apparatus by way of the support means the undercarriage is rotatable for a change of direction. According to a preferred embodiment variant of the invention a particularly simple construction is attained in that the extension segment is connected in a torque-proof manner to the undercarriage and in that the upper carriage is supported in a rotatable manner on the extension segment. Thus, the pivot bearing is displaced upwards according to the upper carriage. As a result, a strain of the bearing, in particular caused by tilting moments, is kept to a minimum. A pivot bearing can also be arranged at the top and bottom of the extension segment.

According to a further embodiment of the invention it is preferred that the support means has at least two carrier arms which extend out from the extension segment in the horizontal direction and that vertical supports are arranged on the carrier arms. In particular, the carrier arms extend transversely to the longitudinal side of the earth working apparatus. For, in the case of a pivoting of the upper carriage by 90° with respect to the undercarriage the greatest risk of tilting lies in this direction.

According to the invention it is particularly preferred that the carrier arms are directed contrary to each other and project laterally beyond the undercarriage. Hence, the carrier arms extend in pairs in such a manner that they are displaced by 180° with respect to the center or pivot axis of the upper carriage. Through this, the buckling resistance of the extension sleeve is increased too.

On the horizontal carrier arms vertical supports are arranged that each connect the carrier arms to the ground. The vertical supports can, on the whole, be arranged in a releasable manner at the outer end of the carrier arms. A preferred embodiment of the invention resides in the fact that the vertical supports each have a support foot which is designed in a vertically telescopic manner. The vertical supports can have thereby an upper receiving sleeve, in which the support foot is supported in a movable manner. This vertical telescoping capability can be effected manually or by means of a positioning cylinder.

Basically, more than two carrier arms can be provided on the support means, by preference four carrier arms. According to an embodiment variant of the invention it is preferred thereby that the support means has carrier arms which are designed as a support cross. The support means has a central support ring that surrounds the sleeve-shaped extension segment. From the external side of the support ring the carrier arms extend in the horizontal direction and thus form a horizontal support cross.

An advantageous embodiment of the invention resides in the fact that the extension segment has a height of at least 0.5 m, preferably 1 m to 4 m. In this way, a noticeable raising of the upper carriage is attained while high support safety can still be achieved with the support means provided in accordance with the invention.

Basically, the undercarriage can be of any chosen design, such as being equipped with wheels. According to the invention an especially suitable embodiment resides in the fact that the undercarriage is designed as a crawler-track running gear. This proves to be particularly advantageous on rough construction site terrain and has a large contact surface and thus high safety against tilting.

As earth working apparatus according to the invention cutters, pile drivers for driving in sheet piles or similar construction machines can be provided. According to the invention it is especially suitable that the earth working apparatus is designed as a drilling apparatus with a mast, along which a drill drive is supported in a vertically adjustable manner. Especially during a pivoting of an upper carriage with a mast arranged thereon care must be taken to ensure particularly good safety against tilting which is accomplished by the invention. In particular, in conjunction with a drilling apparatus a so-called casing machine can be provided as a supplementary means in order to screw a drill pipe separately into the borehole. The casing machine can, in particular, be arranged separate from the earth working apparatus. Hence, in combination with the earth working apparatus according to the invention a relatively large and high casing machine can also be used with a drilling apparatus, without having to excavate a recess for the casing machine or set up a pedestal for the drilling apparatus at each drilling location.

The method according to the invention is characterized in that for earth working an earth working apparatus as described beforehand is used, wherein the upper carriage with the extension segment has a distance to the surface of the ground which is greater than the height of the supplementary means. In this way, an efficient earth working along with a pivoting of the upper carriage can be implemented, while the risk of a collision of the upper carriage with the supplementary means during pivoting is avoided.

According to the invention it is especially preferred that the earth working is carried out as a drilling operation and a bore is produced, that as supplementary means a casing machine is provided around the bore as working location and that with the casing machine at least one support pipe is introduced into the bore. Thus, a cased bore can be produced efficiently. Especially in the production of several bores, as required for bored pile walls for example, an efficient process is achieved without having to provide separate recesses or pedestals at the bore.

Figure 2:
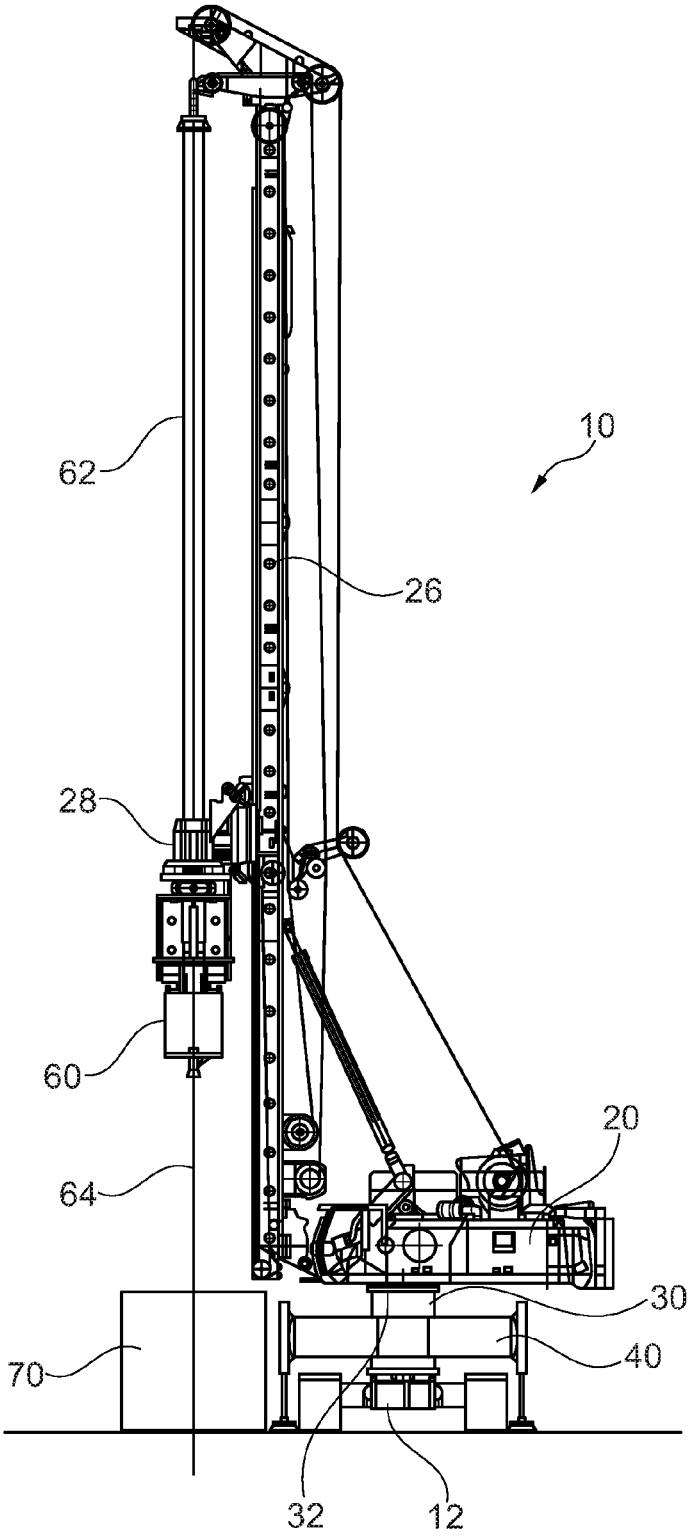
Figure 3:
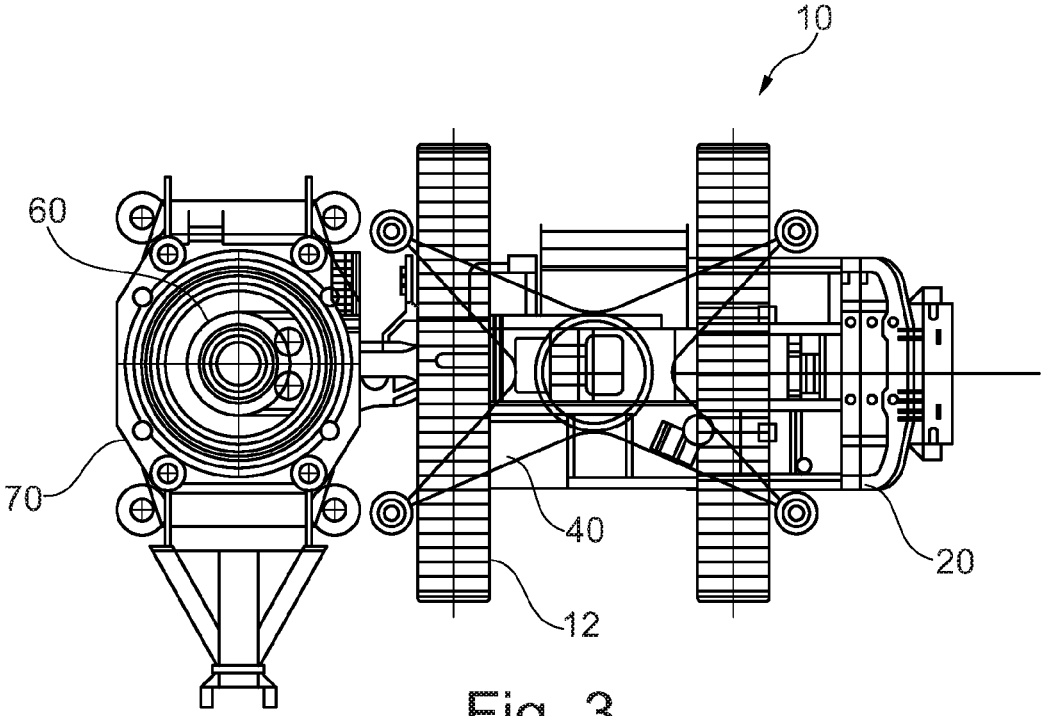
Figure 4:
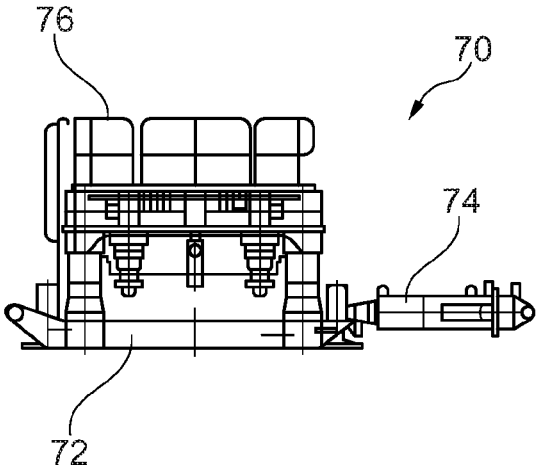

In the following the invention is described in greater detail by way of preferred embodiments illustrated schematically in the accompanying drawings, wherein show:

FIG. 1 a perspective partial view of an earth working apparatus according to the invention;

FIG. 2 a scaled-down side view of the earth working apparatus of FIG. 1 with a schematically illustrated supplementary means;

FIG. 3 a top view of an earth working apparatus according to the invention on a casing machine; and FIG. 4 a side view of the casing machine of FIG. 3 from the front.

According to FIG. 1 an earth working apparatus 10 pursuant to the invention has an undercarriage 12 designed as a crawler-track running gear. On a central carrier frame 14 of the undercarriage 12 a crawler unit 16 is in each case arranged laterally in a known manner. Above the undercarriage 12 an upper carriage 20 is supported in a rotatable manner in the horizontal direction.

The upper carriage 20 has a base frame 21, to the front side of which a vertical mast 26 is linked in a pivotable manner. Furthermore, on the front side of the upper carriage 20 a driver's cab 22 is arranged for operating the earth working apparatus 10. In addition, on the base frame 21 of the upper carriage 20 the drive units and in particular drive motors for the undercarriage 12, the winches and the hydraulic components are provided. These units are encased in a housing 24 of the upper carriage 20. In the illustration according to FIG. 1 the winches and the hydraulic positioning cylinders for actuating the mast 26 are omitted for the sake of clarity.

Between the undercarriage 12 and the upper carriage 20 a sleeve-shaped extension segment 30 is arranged, through which the upper carriage 20 is displaced upwards by approximately 2 m in the illustrated embodiment. On the external side of the sleeve-shaped extension segment 30 a support means 40 with a central carrier ring 42 is mounted. From the central carrier ring 42 four horizontal carrier arms 44 extend radially outwards in the form of a cross. The carrier arms 44 each project laterally beyond the undercarriage 12. At the free ends of the carrier arms 44 a vertical support 46 is in each case mounted by means of a bolt connection. The vertical supports 46 each have an external sleeve 47, in which a telescopic bar 48 is guided in a movable manner and is capable of being secured. At the lower end of the telescopic bar 48 a plate-shaped support foot 50 is arranged, through which, besides the crawler units 16, the earth working apparatus 10 can be additionally supported with respect to the ground.

In FIG. 2 the earth working apparatus 10 of FIG. 1 is shown as being designed as a drilling apparatus. Along the vertical mast 26 a drill drive 28 is guided in a vertically movable manner. By way of the drill drive 28 a drilling tool 60 can be driven in a rotating manner via a rope-suspended Kelly bar 62. In the depicted embodiment the drilling tool 60 is designed as a drilling bucket. During drilling by means of a drilling bucket this fills up with removed drilling material. When the drilling bucket has been filled appropriately, it has to be withdrawn from the borehole and emptied outside the borehole. For this purpose, the upper carriage 20 is normally pivoted by 180° with respect to the undercarriage 12 into an emptying position. In the emptying position a truck is normally located underneath the drilling bucket, which receives the drill spoil by opening the bottom of the drilling bucket and can transport this to a waste disposal site. Afterwards, the drilling tool 60 is pivoted back into a drilling axis 64 so that the drilling tool 60 can be sunk again and the bore can be advanced further.

Around the drilling location as working location a supplementary means 70 is arranged which is shown schematically as a box in FIG. 2.

Due to the arrangement of the sleeve-shaped extension segment 30 between the undercarriage 12 and the upper carriage 20, the said upper carriage 20 is displaced upwards with respect to a surface of the ground. As a result, an underside of the upper carriage 20 is arranged above an upper edge of the supplementary means 70. This allows the upper carriage 20 to be pivoted horizontally via a pivot bearing 32 at the upper end of the sleeve-shaped extension segment, without the upper carriage 20 colliding with the supplementary means 70.

According to FIG. 3 the earth working apparatus 10 of FIG. 2 is shown in an extremely schematic view from above, with the supplementary means 70 being designed as a casing machine 70.

In the depicted illustration the upper carriage 20 is pivoted by 90° with respect to the undercarriage 12. Furthermore, the support means 40 designed as a support cross with four carrier arms 44 is illustrated. In the depicted position the upper carriage 20 is located in the operating position, in which the drilling tool 60 can be introduced through the supplementary means 70 into the ground.

According to FIG. 4 the supplementary means 70 designed as a casing machine in accordance with FIG. 3 is shown in greater detail. The casing machine has a base frame 72 which is provided with drive units 74 for the additional screwing-in of drill pipes that can have a diameter ranging from 0.5 m to 3 m and more. The drive units 74 are hydraulic cylinders in particular, with which the drill pipe to be introduced can be clamped and rotated. The base frame 72 can be walked on and is provided with a railing 76 on its upper side. Typically, such a casing machine has a height of 2 to 3 m.

By way of the earth working apparatus 10 designed in accordance with the invention an efficient earth working can be implemented without any additional constructional measures for lowering the supplementary means 70 or raising the earth working apparatus 10.

The invention claimed is:

1. A drilling apparatus comprising:

an undercarriage, which is designed as a running gear, an upper carriage, which is supported in a rotatable manner on the undercarriage and has a driver's cab as well as a drive motor for the undercarriage, and a mast arranged on the upper carriage, along which a drill drive is supported in a vertically adjustable manner, wherein the upper carriage is horizontally aligned with respect to the undercarriage defining a horizontal plane extending through the upper carriage, between the undercarriage and the upper carriage, an extension segment is arranged, through which a vertical distance between the undercarriage and the upper carriage is extended, and on the extension segment between the undercarriage and the upper carriage, a support and tilt protection device is mounted.

2. The drilling apparatus according to claim 1, wherein the extension segment is designed in a sleeve-shaped manner.

3. The drilling apparatus according to claim 1, wherein the extension segment is non-rotatably connected to the undercarriage, and the upper carriage is supported in a rotatable manner on the extension segment.

4. The drilling apparatus according to claim 1, wherein the support and tilt protection device has at least two carrier arms, which extend out from the extension segment in the horizontal direction, and vertical supports are arranged on the carrier arms.

5. The drilling apparatus according to claim 4, wherein the carrier arms are directed contrary to each other and project laterally beyond the undercarriage.

6. The drilling apparatus according to claim 4, wherein the vertical supports each have a support foot, which is designed in a vertically telescopic manner.

7. The drilling apparatus according to claim 4, wherein the support and tilt protection device has four carrier arms, which are designed as a support cross.

8. The drilling apparatus according to claim 1, wherein the extension segment has a height of at least 0.5 m.

9. A drilling apparatus according to claim 8, wherein the height is 1 m to 4 m.

10. The drilling apparatus according to claim 1, wherein the undercarriage is designed as a crawler-track running gear.

11. A method for drilling, in which on a ground around a working location an auxiliary device is arranged, which has a predetermined height with respect to the surface of the ground, wherein for drilling, the drilling apparatus according to claim 1 is used, wherein the upper carriage with the extension segment has a distance to the surface of the ground which is greater than the height of the auxiliary device.

12. The method according to claim 11, wherein the drilling is carried out as a drilling operation and a bore is produced, as the auxiliary device, a casing machine is provided around the bore as a working location, and with the casing machine, at least one support pipe is introduced into the bore.

* * * * *